US007540250B2

(12) United States Patent
Sjostedt et al.

(10) Patent No.: US 7,540,250 B2
(45) Date of Patent: Jun. 2, 2009

(54) FIBER COMPOSITE CONTINUOUS TENSION MEMBERS FOR SAILBOAT MASTS AND OTHER TENSIONING MEMBER SUPPORTED STRUCTURES

(75) Inventors: Robbie J. Sjostedt, Foothill Ranch, CA (US); Scott Vogel, Jamestown, RI (US)

(73) Assignee: Air Logistics Corporation, Monrovia, CA (US)

( * ) Notice: Subject to any disclaimer, the term of this patent is extended or adjusted under 35 U.S.C. 154(b) by 303 days.

(21) Appl. No.: 11/475,464

(22) Filed: Jun. 26, 2006

(65) Prior Publication Data

US 2007/0295256 A1 Dec. 27, 2007

(51) Int. Cl.
*B63H 11/00* (2006.01)

(52) U.S. Cl. ..... 114/111

(58) Field of Classification Search ..... 114/111, 114/109; 57/210, 200, 201, 206, 237, 238
See application file for complete search history.

(56) References Cited

U.S. PATENT DOCUMENTS

2004/0154516 A1* 8/2004 Thomas ..... 114/102.1
2006/0120672 A1* 6/2006 Cody et al. ..... 385/86

* cited by examiner

*Primary Examiner*—Ed Swinehart
(74) *Attorney, Agent, or Firm*—Christie, Parker & Hale, LLP.

(57) ABSTRACT

A continuous composite rigging system for sailboats. The rigging has a branched shroud rigging harness having a plurality of generally straight and elongate portions and at least one branched portion and at least one spreader end fitting for engaging the at least one branched portion of the branched shroud rigging harness.

25 Claims, 13 Drawing Sheets

—PRIOR ART—

—PRIOR ART—

—PRIOR ART—

—PRIOR ART —

—PRIOR ART—

—PRIOR ART—

— PRIOR ART—

— PRIOR ART—

— PRIOR ART —

FIBER COMPOSITE CONTINUOUS TENSION MEMBERS FOR SAILBOAT MASTS AND OTHER TENSIONING MEMBER SUPPORTED STRUCTURES

BACKGROUND

This invention relates to the field of high strength tension members, such as for sailboat rigging, and more particularly to continuous standing rigging for sailboats utilizing continuous tension members, particularly fiber composite members.

Sailboat designers and builders are constantly striving to improve the standing rigging that holds the masts in the generally vertical position. Since wind can exert tremendous force on the mast, spreaders and supporting rigging, the characteristics of the standing rigging are critical. Some aspects of standing rigging that can be improved include reducing weight, reducing elongation (stretch), reducing wind drag (windage) e.g., by reducing the diameter of the rigging and/or improving its aerodynamic qualities, and reducing the number of rigging parts. The use of high strength and lightweight composite fibers with or without a polymer matrix in lieu of metallic wire rope or metallic rod tensioning members can reduce the mast rigging weight and is important for improved sailboat performance since any weight reduction that takes place above the deck allows for a far greater reduction in the keel weight. Also, to the extent that the number of rigging lines and/or their profiles can be reduced or consolidated, windage can be further reduced.

To date, fiber composite standing rigging systems and rigging systems formed of other materials (e.g., twisted steel cable and solid metal bars) for sailboats have been largely designed and built to the general arrangement commonly known in the sailing industry as "discontinuous rigging". Discontinuous rigging is defined as a standing rigging system supporting a sailboat mast or other similar structure that is made up of a number of discrete tension members. The number of discrete tension member elements in part depends on the number of stabilization strut members (typically called "spreaders" in the yachting field of application) required to support and hold the sailboat mast upright and generally straight. In a discontinuous sailboat mast and rigging assembly, each tensioning member, between any two attachment points, such as the deck, the mast and from spreader to spreader are discrete tensioning member elements with a terminal or end fitting at each end. Consequently, the number of terminal fittings and/or attachment point hardware elements (generally formed of metal) in the overall arrangement is high if there are multiple struts or spreaders required to adequately support the mast along its length. Thus, there is an attendant weight penalty for the large number of metallic terminal fittings in a discontinuous rigging configuration even though lightweight fiber composite tensioning members may be used. Additionally, the terminal fittings are necessarily large in size to accommodate the attachment scheme for connecting the discrete tension member to the mast, spreaders and each other, thereby increasing the wind drag of the entire system.

A typical discontinuous sailboat standing rigging configuration will have both vertical shroud tension members and diagonal shroud tension members. The vertical shroud members more or less extend in a vertical orientation and connect between the port and starboard sides of the deck area and the free ends of the spreaders. The uppermost extending vertical shroud member terminates as a cap shroud near the top of the mast. The diagonal shroud tension members extend from the deck area to the root end of the lowest spreader on the mast, and from ends of the spreader to the mast near the next spreader going up the mast. Consequently, there are numerous directional or angular changes along the length of the tension member general arrangement because the diagonal shroud tension members are necessary to hold the mast straight and because the spreaders are generally not of equal length.

In contrast with a discontinuous rigging system, any continuous rigging system will have numerous bends (directional or angular changes from a straight tension member line at every strut or spreader) along the length of the continuous tension members. These bends become potential areas of weakness in the tension member (e.g., twisted wire rope or a fiber composite tension member) unless the tension member can be tailored to have equal strain in operation across the tension member cross-section at any given point along its length. The weak points are created because the tension member does not have equivalent stress/strain capability across its full cross section in the area of the bend when under tension if the tension member is not made to the required shape including directional or angular changes. A tension member made in the straight form and bent into the required configuration necessary to create a continuous rigging system will have inherent weak points at every bend because the tension member material on the inside of the bend radius at every spreader will not have the same tensile stress capability as the outside radius at the bend in use. The typical point of failure will be at the outside radius of the bend where under a tensile load, the outer portion of the tension member has more strain than the inside of the bend portion and therefore can be overloaded beyond the tensile strength properties of the tension member material.

The ability to design and build truly lightweight and efficient rigging using the principles of continuous rigging versus discontinuous rigging for sailboats and other applications using metallic wire rope and/or metallic rods is currently limited. For example, it is possible to use a single metallic wire rope or metallic rod as a vertical shroud tension member for a conventional multiple spreader sailboat mast. In this example, the metallic tensioning member would be attached at deck level and could pass around various spreaders. In this example, no fittings are used at the various spreaders as would be typical for a discontinuous rig. The metallic rod would be bent around the various spreader ends along its length. There is some loss of strength where the metallic rod is bent but the yield properties of metal make this approach somewhat feasible. However, to date, there is no known way to taper the metallic rod tension member along its length thereby reducing weight aloft as the respective forces diminish. Furthermore, there is no known method to split the metallic rod or wire rope off to make other tension member elements creating necessary diagonal shroud members without additional tension member end fittings terminals. Thus, there is an incumbent weight and windage penalty. For this reason, discontinuous rigs have been the dominant practice for both metal and fiber composite rigging. It is possible to have multiple metallic tension members at various lengths (all anchored at deck level) and taper off the diameters of these tension members over the length of the mast (some members acting as diagonals) but this still is an inefficient design in terms of weight, complexity and windage. A continuous fiber composite rigging system would be a significant advancement in terms of optimized strength where required, limited stretch, and overall weight and windage reduction.

Accordingly, if the number of metallic terminals for the overall sailboat standing rigging system is significantly reduced, the result will be less weight, fewer parts, reduced wind resistance and improved strength characteristics.

There accordingly remains a need for improved sailboat rigging having a configuration specifically utilizing fiber composite materials, fewer metallic terminals, and a reduced profile.

DETAILED DESCRIPTION

Figure 1:
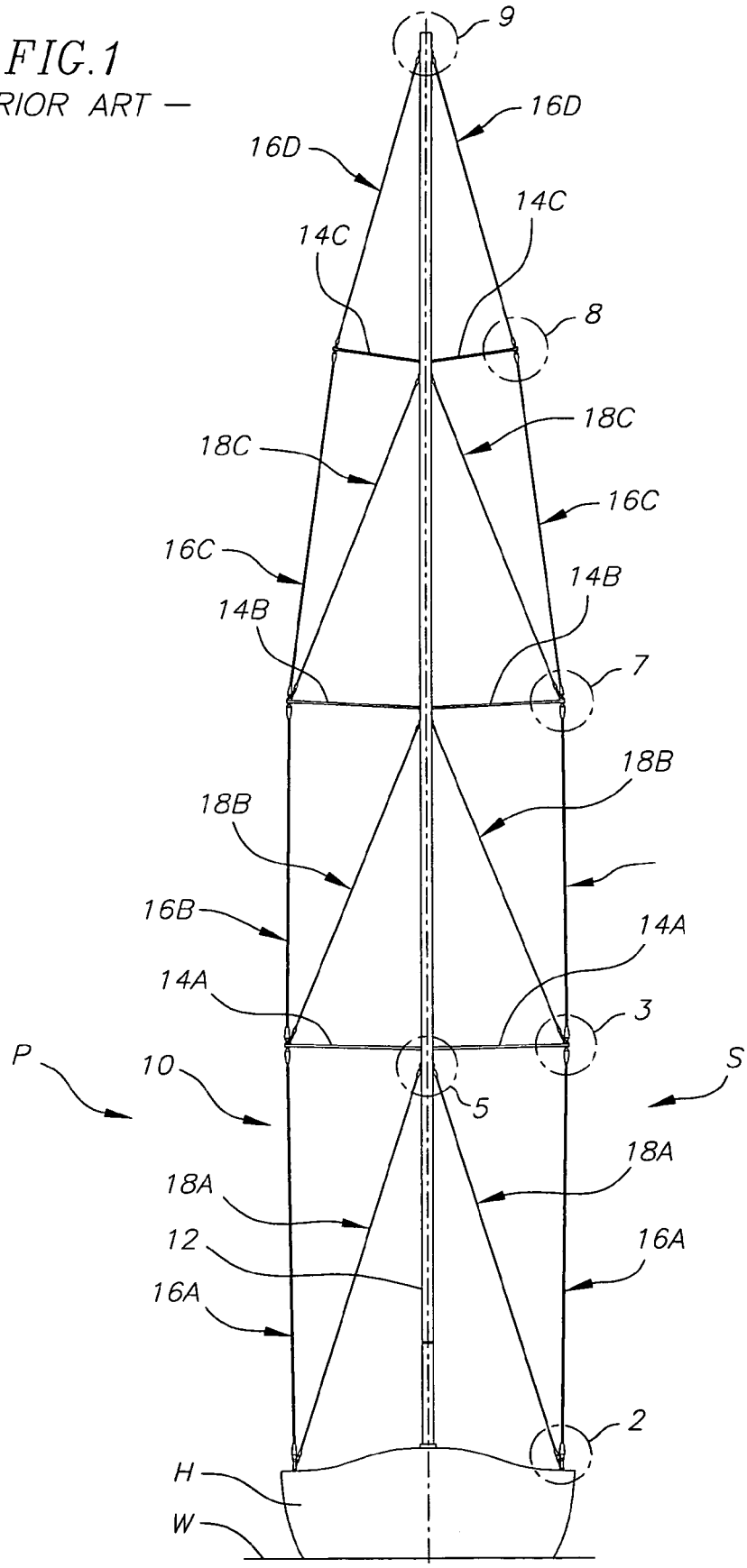
FIG. 1 is a diagrammatic, stern end view of an exemplary sailboat outfitted with discontinuous fiber composite tensioning members of the prior art.

The invention is directed to "continuous rigging" configurations designed and constructed using preferably lightweight fiber composite tensioning member technology, with a reduced number of terminal fittings compared to conventional discontinuous rigging configuration of the prior art.

The continuous fiber composite rigging system will be tapered (reduced in cross section) in stages as it progresses up the mast height, further reducing weight aloft. This is desirable since the forces on the rigging are less at the top of the mast compared to the lower along the length of the mast. A further benefit is a cost reduction because of the elimination of many metallic terminal fittings necessary with conventional discontinuous rigging systems.

By manufacturing fiber composite tension members with equal tension and uniform stress capability on the fiber elements (even though the length is not the same for all fiber elements), a continuous rigging system can be built with numerous bends along the length of the tension members without significant loss in strength and with greater fatigue resistance. By this approach the strain on the various fiber elements is uniform in operation, thereby optimizing the strength of the rigging system.

The standing rigging system of the invention is collectively made of fiber composite tensioning member elements of various lengths and including all necessary spreader bend angles such that the fiber elements are continuous along the length of the mast and do not have terminal fittings at each spreader as in discontinuous rigging designs.

All fiber composite tension member elements making up this tensioning member system are equally tensioned and/or manufactured to the ideal path and length such that the fiber elements have equal stress/strain capability thereby optimizing the strength and performance of the continuous rigging system.

The standing rigging system is made up of bundles of fiber composite tensioning member elements in which a percentage of the total number of fiber composite elements do not go from the deck to the top of the mast, but branch off after passing through one or more spreader end fittings and attach to the mast at an intermediate point to also create a diagonal mast supporting tensioning member. The purpose of the diagonal tensioning members is to keep the mast straight along its height (or length). The purpose of the outer shroud and cap shroud tension member is to hold the mast upright and keep the mast straight sideways. The splitting off of fiber composite elements along the length of the mast further reduces weight and windage and tapers the rigging system in steps out over the length of the mast so that material (and weight) is not provided except where necessary.

The continuous fiber composite elements can be equally tensioned during manufacture of the shrouds in the desired path (for diagonal and outer shroud elements) such that the fiber composite elements equally share the load during use. Equally tensioning or properly defining the ideal path length for the various fiber elements can be accomplished in several ways. First, the fiber elements can be equally tensioned when the lower (deck level) terminating fitting is fixed to the collective bundle of fibers. Second, the fiber composite elements can be laid out in their actual system configuration of diagonal and vertical components such that the actual shape and path length for every fiber element is optimized for strength and uniform loading. This can be accomplished either by hand or by manufacturing tooling and/or machinery wherein the fiber elements are individually shaped to create diagonal or vertical shrouds. To be avoided is the manufacture of fiber composite elements in the straight form and then bending them where required to create the continuous rigging configuration because some fibers will be slackened by the bend thereby reducing the strength and performance of the rigging system.

The preferred method of manufacture is to lay out the fiber composite elements in the desired general configuration including all bends and then equally tension all fiber composite elements when connecting the various terminating fittings of the rigging system.

A spreader end fitting is configured to allow the fiber composite elements to pass through the fitting without requiring a plurality of termination fittings to be attached to a tipcup, as would be the case in a discontinuous rigging configuration. For example, the spreader end fitting is preferably held in position relative to the composite tensioning member rods with a polymer, such as epoxy adhesive, other thermoset polymers or rubber material injected into the tubular spreader end fitting. The polymer injected into the spreader fitting can be selected to provide the ideal modulus of elasticity for optimal load sharing of the various fiber composite elements. The tubular spreader fitting is attached to the end of the spreader, for example with a metallic strap or cap fitting held in place with fasteners, or seized to the spreader with seizing wire or fiber lashing. Various designs of spreader end fittings are possible provided such fittings clamp and/or hold the advanced composite fiber or rod elements such that they do not adversely slide relative to each other when tensioned or under a tension load and hold the strut or spreader in the desired position.

The same spreader end fitting described above can comprise a "Y" branch metallic or composite tube that allows a percentage of the fiber composite tensioning member elements to be re-directed at the necessary angular deflection to become a diagonal shroud tensioning member. The various branches of the "Y" tube do not need to be of equal length and can be tailored to suit the strength requirements of the rigging support system.

The fiber composite elements that make up a continuous standing rigging tensioning member system can be bundled into a single bundle, either of round, airfoil or other cross sectional shape, and then split off into separate bundles, or can be grouped into separate bundles for the separate diagonal and vertical shroud members. In the first case, all diagonal and vertical fiber composite elements are bundled together into a desired cross-section, such as a generally circular cross-section bundle at deck level and branch out over the height of the mast. Groups of fiber composite elements are divided off from the main bundle) as necessary progressing up the height of the mast to create the necessary vertical and diagonal rigging tensioning members. In the alternate case, the vertical shroud fiber composite elements can be bundled into one rigging tension member and the various diagonal shroud fiber composite elements can be bundled into separate bundles, with all of the separate bundles being grouped together. The single circular cross section bundle, as described in the first case, has the lowest wind friction drag at all apparent wind angles for conventional mono-hull sailboats. The multiple bundle design can be assembled to have less frontal area and therefore would be expected to have lower drag for high-speed catamarans or ice boats or land yachts where the apparent wind angle is most generally aligned with the path of the vessel and the lowest frontal area is desired.

The continuous fiber composite tensioning member system as described in this disclosure can be made from a variety of advanced composite materials. High strength and high modulus fibers such as carbon fiber, PBO fiber, various aramid fibers along with polymer coatings or as pultruded composite elements made with polymer resins are suitable for this continuous rigging design. Bare fiber, coated fiber materials and pultruded composite materials can be used so long as an effective termination is made to attach the fibers to the required end points. Various fiber terminations are suitable with the continuous rigging system design including friction fittings, continuous loop thimbles and cast compression cone fittings. If desired, the fiber elements can also be made from a non-conductive dielectric material such as fiberglass or high modulus/high strength polyethylene with or without a polymer sizing, polymer coating or polymer matrix.

The fiber composite continuous rigging system described here within can be manufactured either directly on a sailboat mast or structure to be supported or manufactured on tooling that replicates the geometry of the diagonals and verticals so long as the fiber path length at every bend point is prescribed and the fibers are evenly tensioned at the desired length.

Turning now to FIG. 1, there is shown a diagrammatic, stern end view of an exemplary sailboat 10 on the water W having a hull H with a mast 12 with generally horizontal spreaders 14A-C extending port P and starboard S from the mast and outfitted with a plurality of separate generally vertical composite fiber rigging sections (or vertical shrouds) 16A-D and a plurality of generally diagonal composite fiber rigging sections 18A-C (or diagonal shrouds) of the prior art. The terminal ends of the vertical and diagonal shrouds connect to common hardware attachments and to the spreaders and/or mast, as shown in dashed circle areas 2, 3, 5, 7, 8 and 9 and are shown in detail with reference to FIGS. 2, 3, 5, 7, 8 and 9, respectively. Not shown are various adjustment devices (e.g., turnbuckles, etc.) to adjust the tightness and tension on the various sections of the tensioning members.

Figure 2:
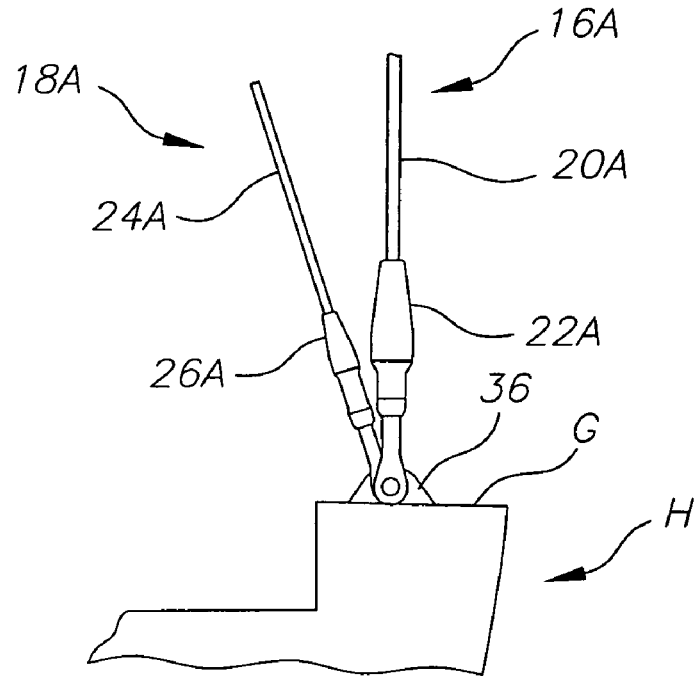
FIG. 2 is a detail of the dashed circle area 2 of FIG. 1 showing attachment of the first tier vertical shroud and the first tier diagonal shroud of FIG. 1 to a boat's gunwale.
Figure 14:
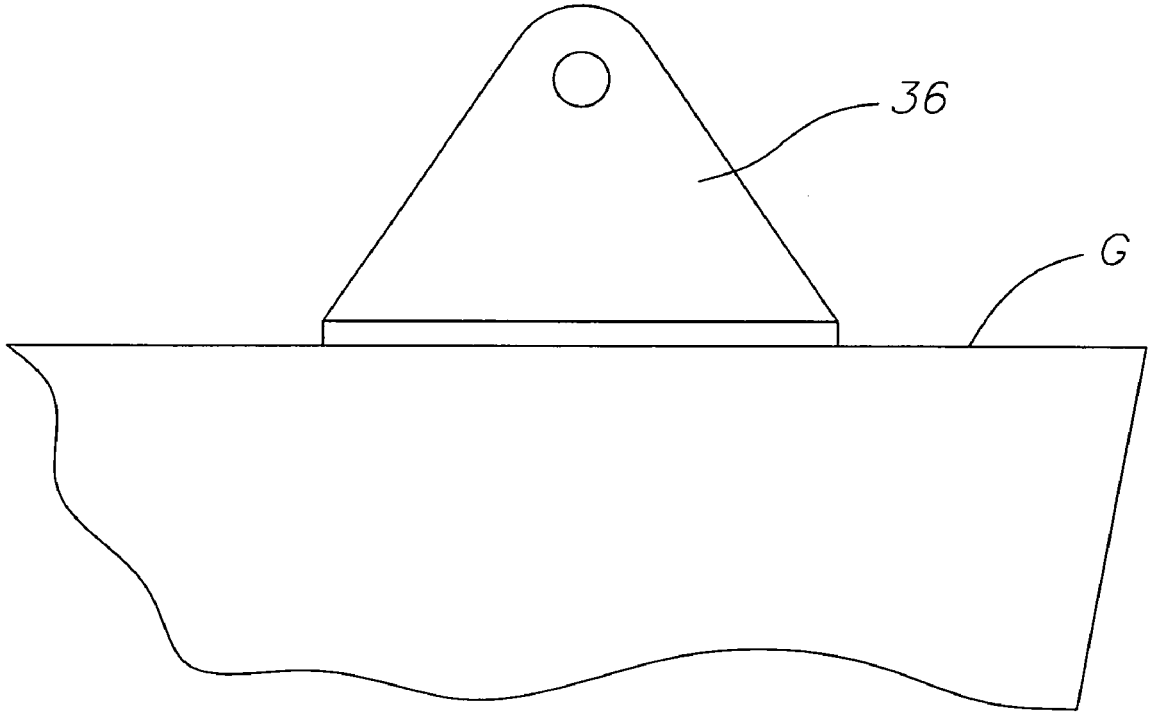
FIG. 14 is front view of an exemplary tang used to hold shrouds to a chainplate on a deck.

FIG. 2 is a detail view of the dashed circle area 2 of FIG. 1 showing attachment of a first tier vertical shroud 16A and first tier diagonal shroud 18A of FIG. 1 to the hull H of the boat. The first tier vertical shroud 16A has a cable portion 20A and a connection fitting 22A and the first tier diagonal shroud 18A has a cable portion 24A and a connection fitting 26A. The connection fittings 22A and 26A are attached to the hull H or some structure mounted to the hull, for example, to a mounting base 36 which mounts to a gunwale G, an example of which is shown in FIG. 14. The cable portions 20A and 24A can be selected from conventional strength member materials, and in the case of composite materials, can comprise carbon-fiber composite material, glass-fiber material, or other materials that are assembled in a conventional manner. The connection fitting 22A and 26A comprise metal such as stainless steel, titanium, etc. In order to effectuate appropriate tightening of the shrouds of the standing rigging, various tightening devices are included. For example, turnbuckles (not shown) may be used to tension the shrouds where appropriate.

Figure 3:
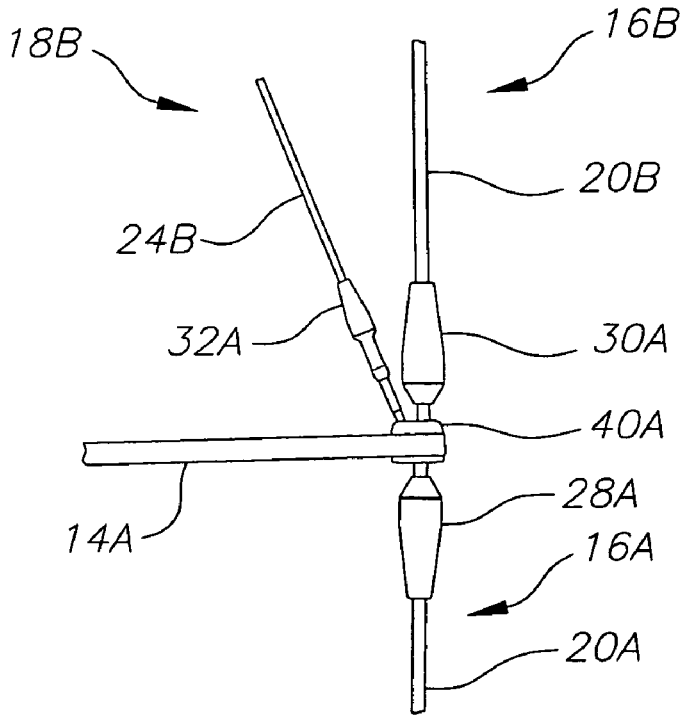
FIG. 3 is a detail of the dashed circle area 3 of FIG. 1 showing the first tier vertical shroud, the second tier vertical shroud and the second tier diagonal shroud, all attached by a tipcup to the first tier spreader.

FIG. 3 is a detail view of the dashed circle area 3 of FIG. 1 showing the first tier vertical shroud 16A, a second tier vertical shroud 16B and second tier diagonal shroud 18B attached by a tipcup 40A to an arm of a first tier spreader 14A. Each of the shrouds 16A, 16B and 18A include cable portions 20A, 20B and 24B, respectively, and terminating end portions 28A, 30A and 32A, respectively.

Figure 4:
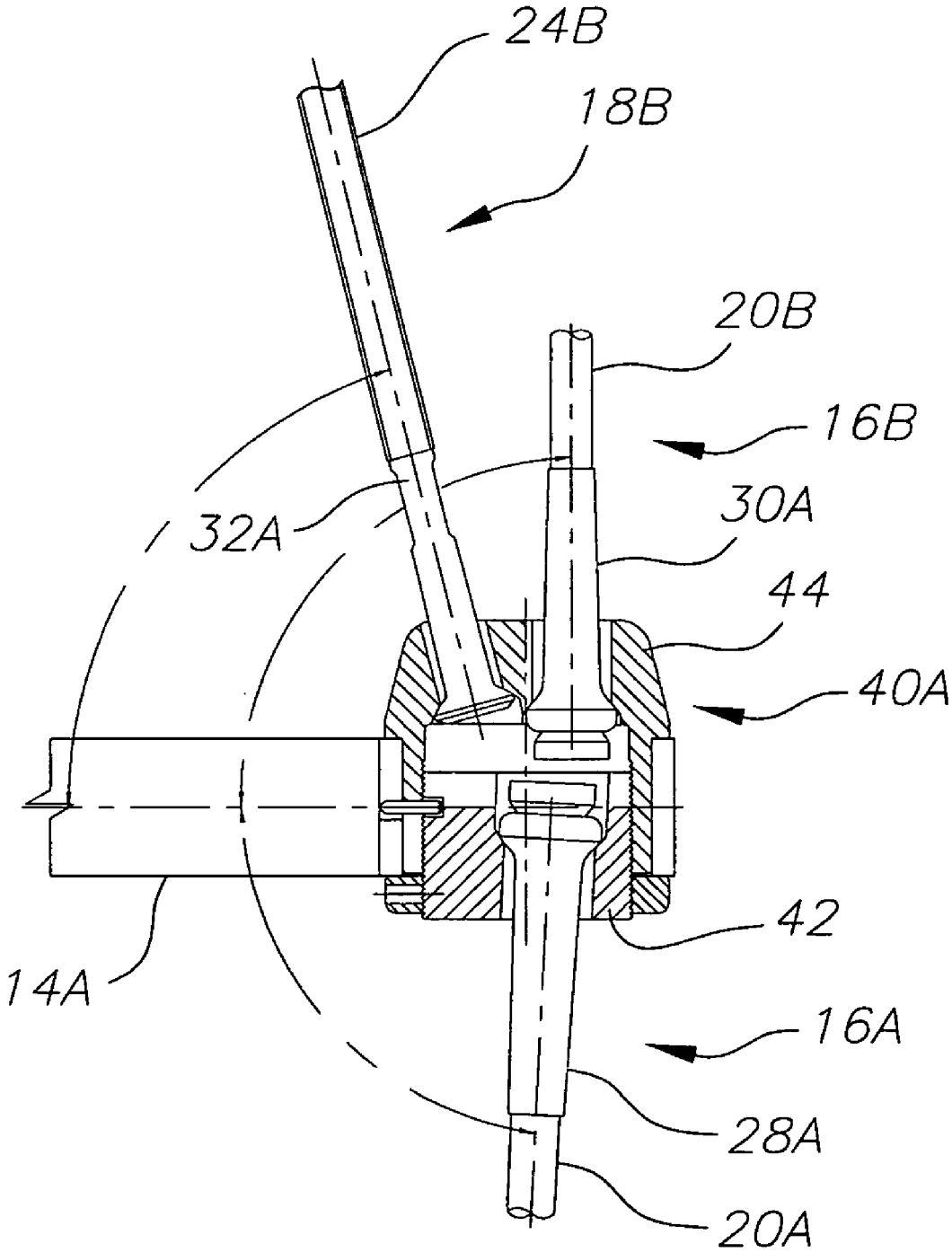
FIG. 4 is a cross-sectional view through the structures shown in FIG. 3.

FIG. 4 is a cross-sectional view through the tipcup 40A attached to the first tier spreader 14A and showing its attached shrouds 16A, 16B and 18B shown in FIG. 3. The tipcup 40A can have a base portion 42 and an upper portion 44 which detachably engage together (e.g., by screwing together) to the spreader 14A and capture the terminating end portions 28A, 30A and 32A of shrouds 16A, 16B and 18B, respectively, while preferably permitting some pivotal movement between the shrouds 16A, 16B and 18B and the tipcup 40A to accommodate adjustments. Other types of tipcups or attachment points can be used.

Figure 5:
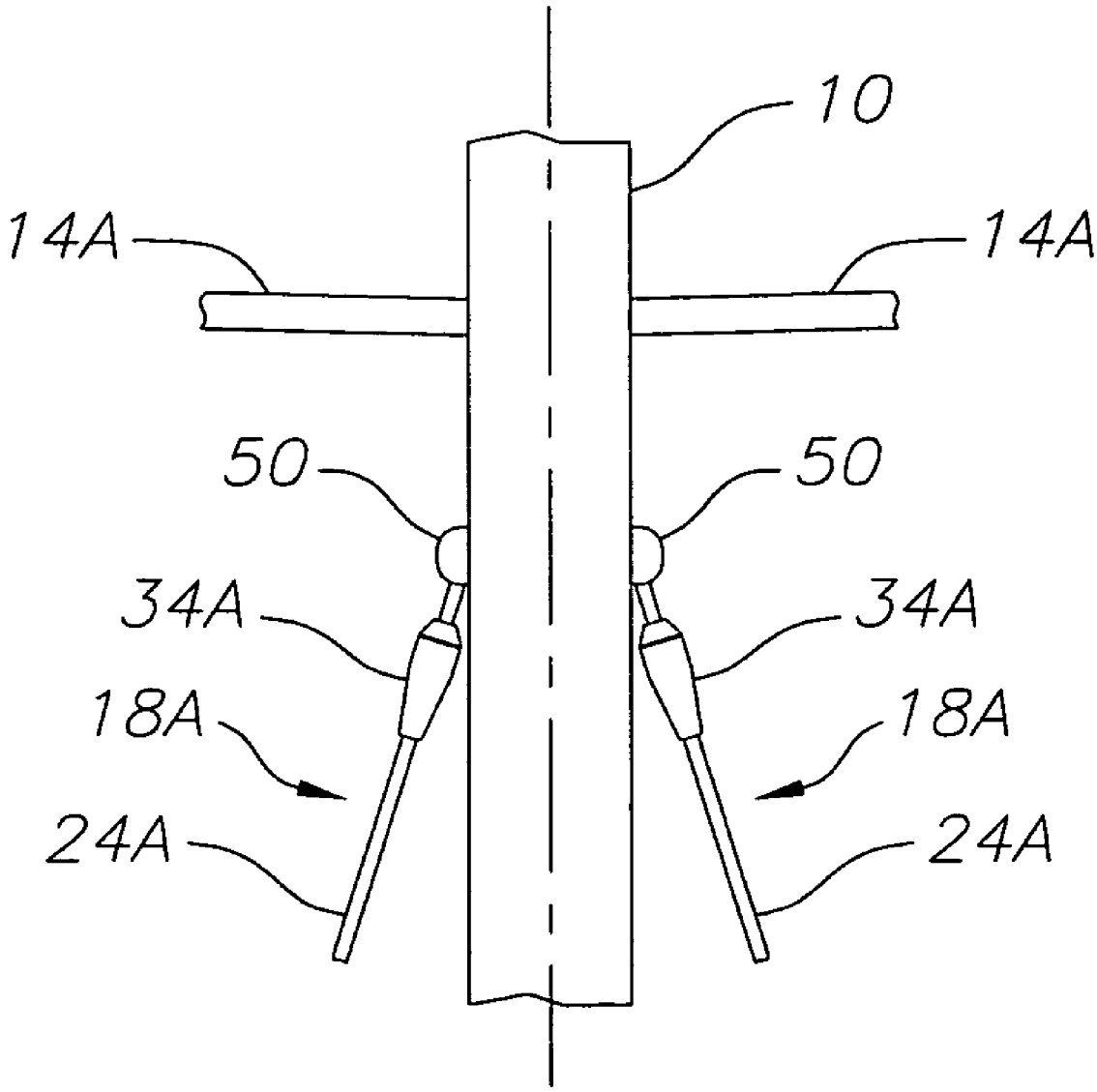
FIG. 5 is a detail of the dashed circle area 5 of FIG. 1 showing the first tier diagonal shroud attached to the mast by a tang.
Figure 6:
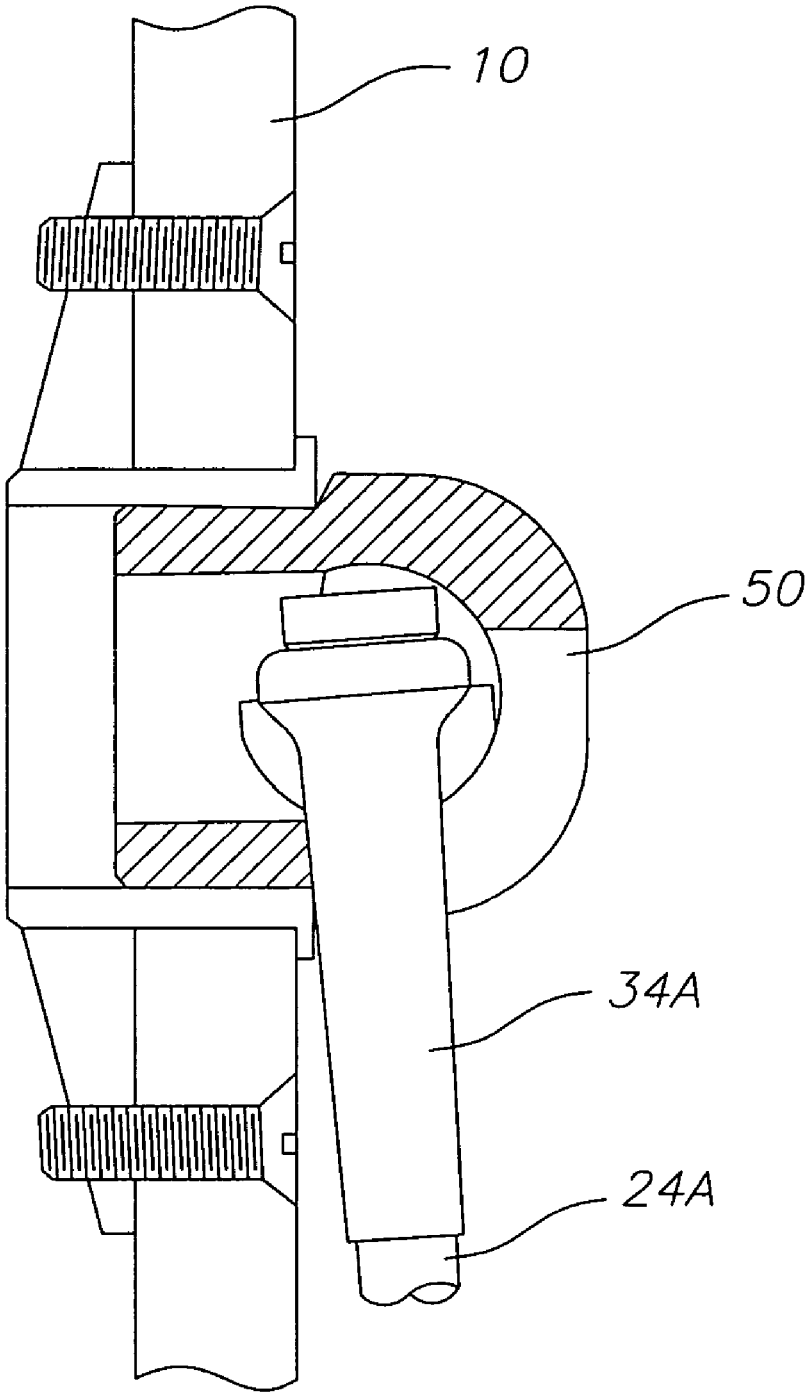
FIG. 6 is a cross-sectional view through the exemplary tang attached to the mast of FIG. 5.

FIG. 5 is a detail view of the dashed circle area 5 of FIG. 1 showing the port and starboard first tier diagonal shrouds 18A with its terminal ends 34A attached to the mast 12 by tangs 50, and FIG. 6 is a cross-sectional view through the exemplary tangs 50 of FIG. 5 attached to the mast 12. The tangs 50 will generally permit some pivotal movement between the terminal ends 34A of the first tier diagonal shrouds 18A and the tang 50 will accommodate different set ups and provide for some flexing and movement of components during set up and installation.

Figure 7:
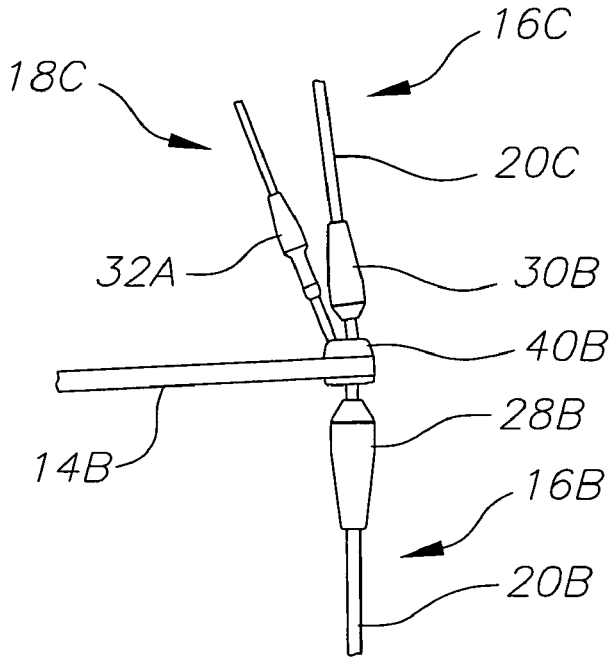
FIG. 7 is a detail of the dashed circle area 7 of FIG. 1 showing the second tier vertical shroud, the third tier vertical shroud and the third tier diagonal shroud attached by a tipcup to the second tier spreader.

FIG. 7 is a detail view of the dashed circle area 7 of FIG. 1 showing the second tier vertical shroud 16B with a cable portion 20B and terminal end fitting 28B, a third tier vertical shroud 16C with a cable portion 20C and terminal end fitting 30B, and third tier diagonal shroud 18C with a cable portion 24C and terminal end fitting 32B attached by a tipcup 40B to a second tier spreader 14B. The arrangement is typically the same as with the setup shown in FIG. 3.

Figure 8:
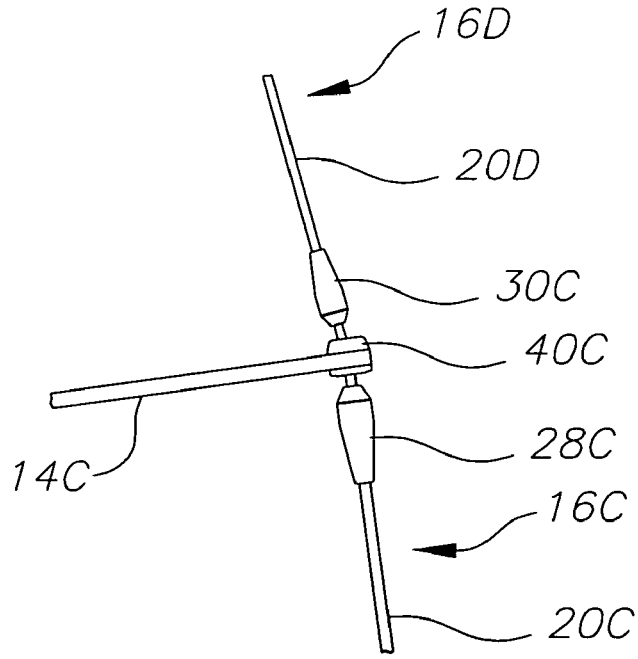
FIG. 8 is a detail of the dashed circle area 8 of FIG. 1 showing the third tier vertical shroud and the fourth tier diagonal shroud attached to the third tier spreader.

FIG. 8 is a detail view of the dashed circle area 8 of FIG. 1 showing the third tier vertical shroud 16C, the fourth tier vertical shroud 16D attached to the third tier spreader 14C by a tipcup 40C. As can be seen, this arrangement is somewhat similar to the tipcup arrangement on the first and second tiers of spreaders, but only includes two shrouds. The shrouds 16C and 16D include cable portions 20C and 20D and terminating end portions 28C and 30C, respectively.

Figure 9:
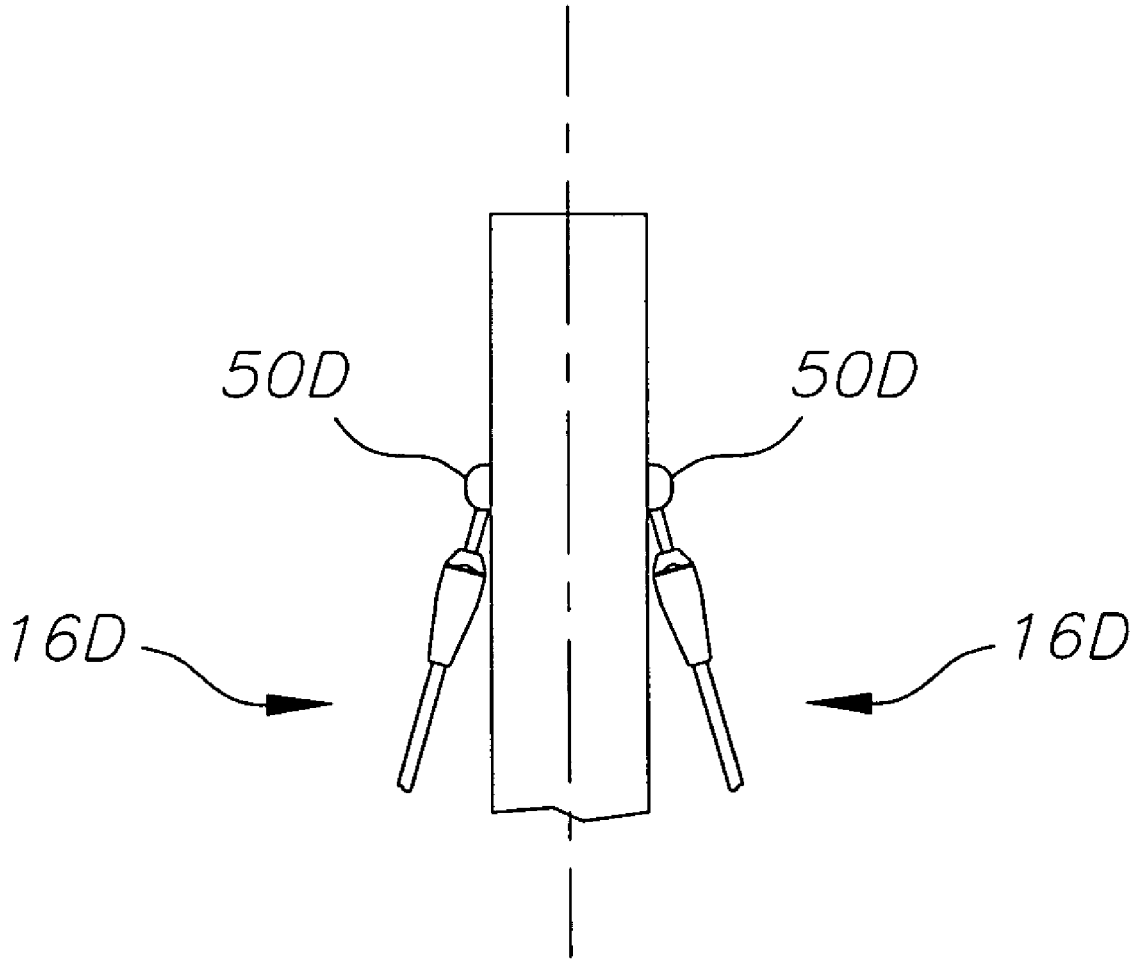
FIG. 9 is a detail of the dashed circle area 9 of FIG. 1 showing the fourth tier diagonal shroud attached to the mast by a tang.

FIG. 9 is a detail view of the dashed circle area 9 of FIG. 1 showing the fourth tier vertical shrouds 16D (which are running almost diagonally in this region) attached near the top of the mast 12 by tangs 50D.

The typical discontinuous rigging system shown and described with reference to FIGS. 1-9 includes a large number of individual elongate and straight rigging sections, each having a termination fitting on each of their two ends, which termination fittings are attached to fixtures on or near the deck, the spreaders and mast. Thus, with the prior art discontinuous rigging system as described above, a relatively large number of terminating fittings and tip cups are required. Since these components are metallic and somewhat enlarged, they not only put extra weight above the sailboat deck, but increase windage, which as previously described, is undesirable.

Figure 10:
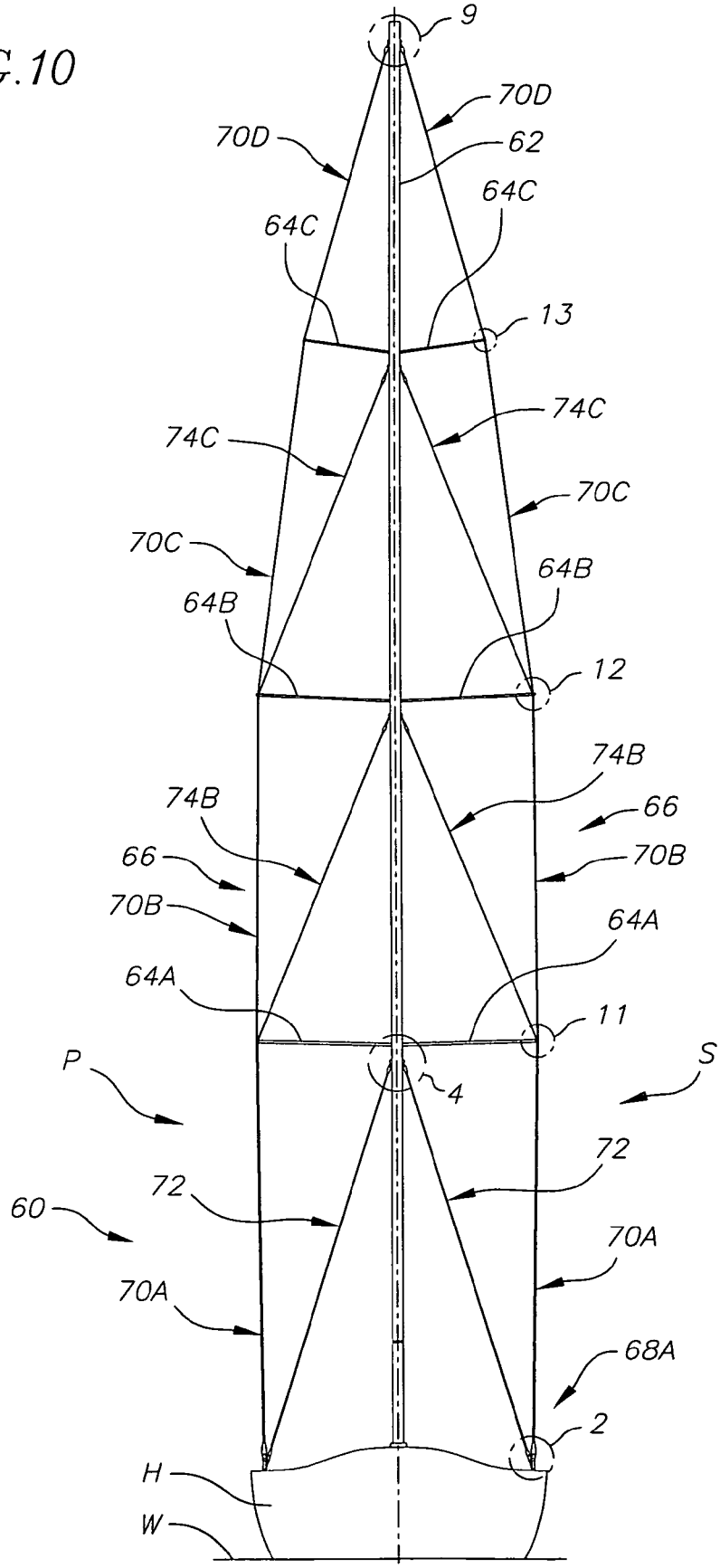
FIG. 10 is a diagrammatic, stern end view of an exemplary sailboat outfitted with continuous fiber composite tensioning members of the invention.

FIG. 10 is a diagrammatic, stern end view of an exemplary sailboat 60 on the water W having a hull H with a mast 62 with generally horizontal spreaders 64A-C (with the upper spreaders often being tilted slightly upwardly) extending port P and starboard S from the mast 62 and outfitted with continuous composite rigging harnesses 66 of the invention which are located on the port P and starboard S sides of the sailboat. Not shown are various adjustment devices (e.g., turnbuckles, etc.) to adjust the tightness and tension the various sections of the continuous composite rigging harness. The connection ends of the vertical and diagonal shroud sections connected to the spreaders or mast are shown in dashed circle areas 2, 4, 9, 11, 12 and 13 of FIG. 10 and are shown in more detail with reference to FIGS. 2, 4, 9, 11, 12 and 13, respectively. Unlike the discontinuous rigging system of the prior art with a large number of individual elongate and straight rigging sections with termination fittings on each of their two ends (as shown in FIGS. 1-3, 7 and 8), the continuous rigging of the invention eliminates some or all of the terminating fittings previously used at tips of the spreaders, and instead relies of branching of the continuous composite rigging harness 66 to establish the various generally vertical and generally diagonal cable runs that span between the deck, spreaders, mast and other parts of the sailboat. While the continuous composite rigging harnesses 66 on the port and starboard side are shown as single structures, the continuous composite rigging harnesses 66 can comprise less than all of the shroud sections on the port and/or starboard side for each mast, and can be used in combination with other rigging components including discontinuous shrouds (e.g., a separate first tier diagonal shroud), such as those described above with reference to FIGS. 1-9, and can also be used to span structures and components located between the bow and stern of the sailboard.

The details of dashed circle sections 2, 5 and 9 are shown as with regards to FIGS. 2, 5 and 9, respectively, except that instead of comprising discrete and individual shrouds, the sections of the continuous composite rigging harness 66 are used.

A lowermost terminal end portion of a first tier vertical section 70A of the continuous composite rigging harness 66 is connected to some structure (e.g., a mounting base 36, such as shown in FIG. 14) which in turn is mounted to the deck area, a chainplate G, or other structure of the sailboat, for example, such in the same manner as shown and described with reference to FIG. 2. Separate, diagonal located sections of rigging 72 can be used, as described with reference to FIG. 2, and is attached at its uppermost end to the mast by tangs 50, such as shown in FIGS. 5 and 6, or by other known parts and components. Other generally vertically extending vertical sections of rigging 70B, 70C and 70C are included, along with other diagonally extending sections 74B, 74C and 74D. The uppermost diagonal section 74D of the continuous composite rigging harness 66 is attachable to near the top of the mast 62 by a tang, in the manner as shown in FIG. 9.

Although the term "vertically" and "diagonally" are used herein, the continuous composite rigging may be oriented in other directions relative to the sailboat, and what is important is that there are various sections of the harness, including some that branch out at an angle from other sections, and that at their branching points, and points where turns occur, that the strength is not compromised.

Figure 11:
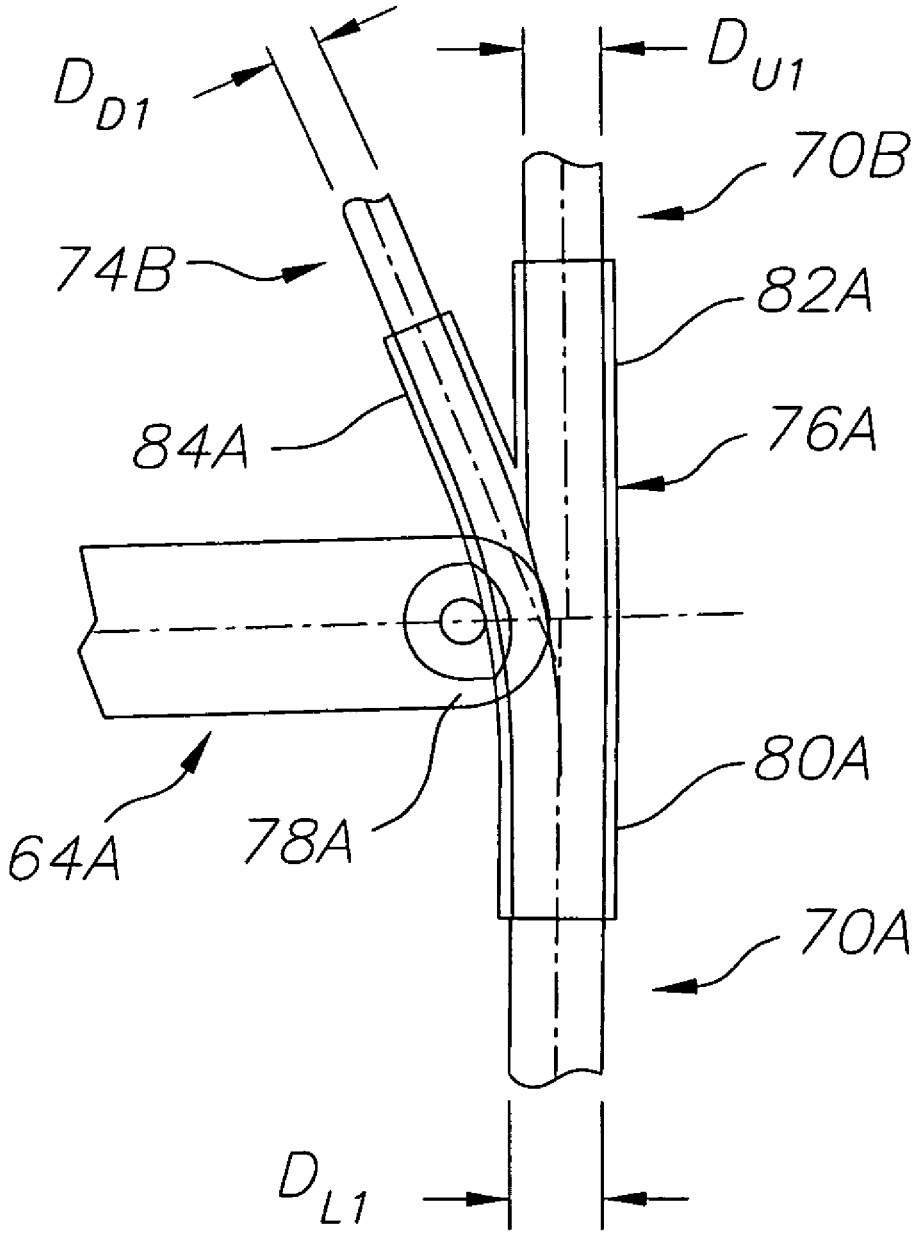
FIG. 11 is a detail of the dashed circle area 11 of FIG. 10 showing the first tier vertical shroud portion, the second tier vertical shroud portion and the second tier diagonal shroud portion engaged by the engagement member to circle the first tier spreader.
Figure 15:
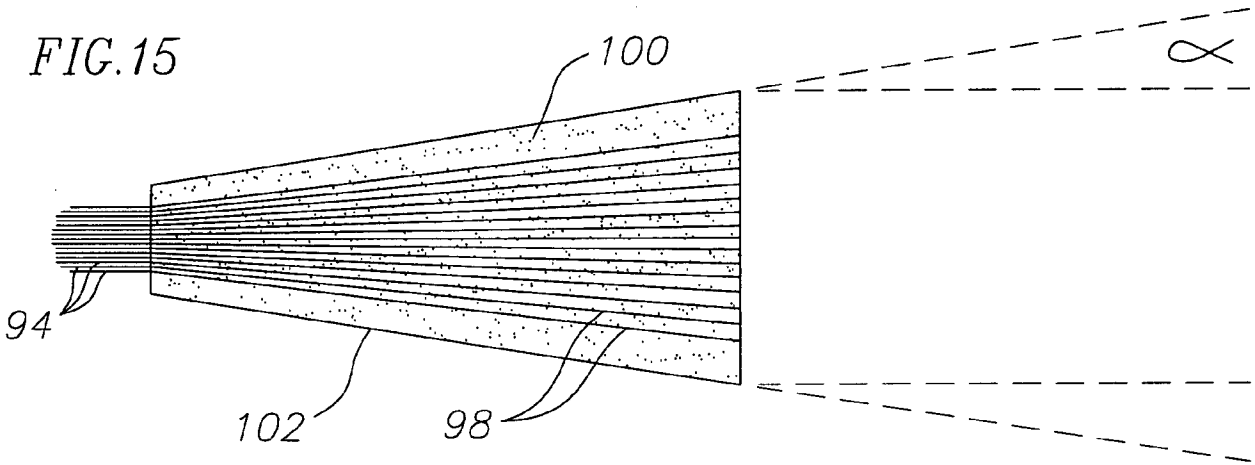
FIG. 15 is a cross-sectional view of an exemplary end piece of a composite tension member used in the continuous composite rigging system of the invention with overlay material removed.
Figure 16:
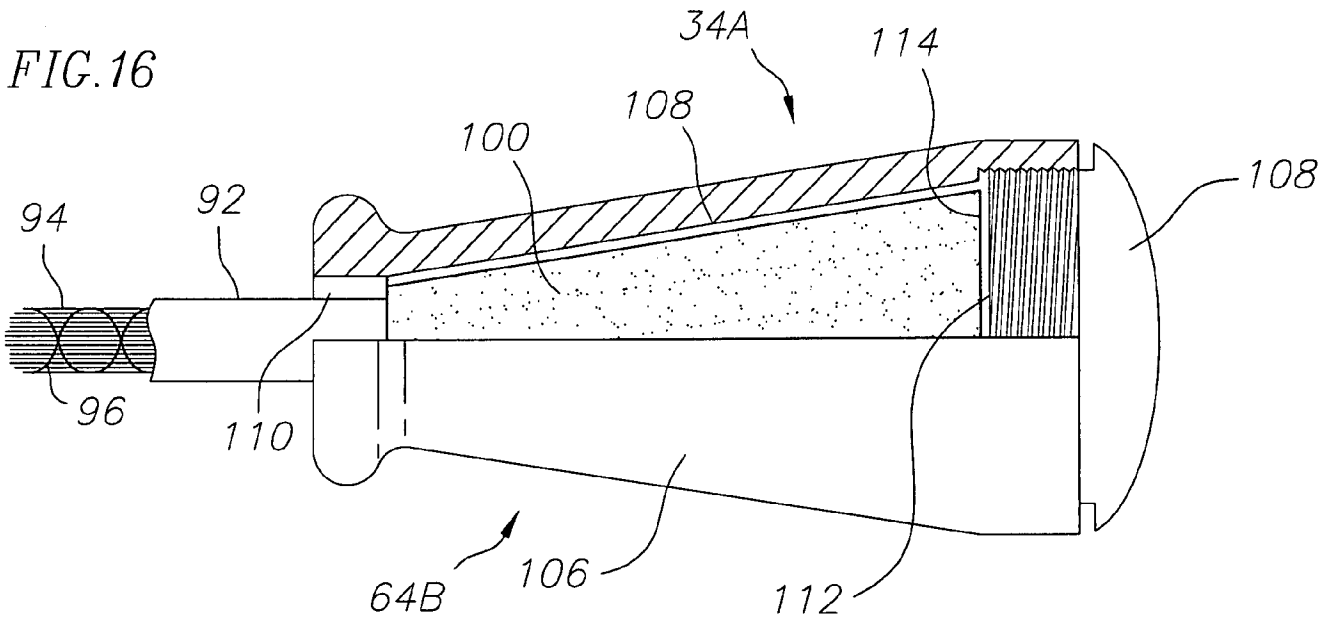
FIG. 16 is a partially exposed view of an exemplary end piece of a composite tension member of FIG. 15 retained in a terminal fitting of a section of composite rigging of the invention.

Turning now to FIG. 11, there is shown a detail of dashed circled area 11 of FIG. 10 showing a portion of the first tier vertical shroud section 70A, the second tier vertical shroud section 70B and the second tier diagonal shroud section 74B engaged by an engagement member 76A to the first tier spreader 64A. The engagement member 76A comprises a branching tube (or guide) structure which is fitted to an end 78A of the spreader 64A. The branching tube or guide structure 76A may have an entry arm 80A having an internal opening sized to fit the first tier vertical shroud section 70A with a diameter $D_{L1}$, a first exit arm 82A for passage of the second tier vertical shroud section 70B which has a second tier vertical shrouds section diameter $D_{U1}$, and a second exit arm 84A for passage of the second tier diagonal shroud section 74B, which tier diagonal shroud section 74B has a diameter $D_{D1}$. The branching tube structure 76A can be made of high strength metal, such as stainless steel, titanium, composite materials, and the like, and can be placed around the branching areas of the shroud sections, e.g., by two halves of the branching tube structure that are connected together. The shroud sections will be mechanically and/or adhesively connected to the branched tube structure 76A so that the shroud sections are immobilized and cannot move relative to the branched tube structure 76A. As examples of adhesives, epoxy adhesive or rubber can be injected into the branching tube structure and can be selected to provide the ideal modulus of elasticity for optimal load sharing of the various fiber composite elements. Two examples of mechanical connections include sizing the tubes so that they tightly clamp around the shroud sections, and engaging clamps on the shroud sections to prevent movement of the shroud sections relative to the branched tube structure 76A, but other mechanical devices can be used as well. In the invention, the continuous composite rigging harness 66 is formed of a plurality of individual elongate strength elements, namely composite rods 94, such as carbon fiber/epoxy composite rods. Other combinations of high strength fibers or high strength fibers in a polymer matrix are also suitable for continuous rigging. The rods or fibers are bundled and held together, such as by overwrapping material to cover elongate shroud sections and the branching portions of the shroud sections, as shown in FIGS. 15 and 16 with a protective braided fiber covering or a neoprene rubber jacket.

As noted above, in lieu of bundling all of the elongated strength elements together into a single bundle and dividing out groups of bundles (e.g., into diagonal and vertical shroud portions), the number of individual strength elements that will form each of the diagonal or vertical shroud sections in the continuous composite rigging harness can be individually bundled, and then in turn bundled together with other bundled sections. In other words, the section of the continuous composite rigging harness 66, in the region 70A, will comprise bundles of individual strength elements that will make up the vertical shroud sections 70B, 70C and 70D, and diagonal shroud sections 74B and 74C, while the section of the continuous composite rigging harness 66, in the region 70B will comprise bundles of individual vertical shroud sections 70C and 70D end diagonal shroud section 74C.

In FIG. 11, the bundle of composite fibers or rods that enter the entry tube 80 as the first tier vertical shroud section 70A is separated into two separate bundles, namely the second tier vertical shroud section 70B and the second tier diagonal shroud section 74B (or a plurality of bundles that are together bundled can be separated). A certain number of the composite fiber rods will be directed from the larger bundle of rods entering the entry tube 80A and diverted to the first and second exit arms 82A & 84A. As an example, if the first tier vertical shroud section 70A is formed of 150 individual rods and 60 rods are branched off for the second tier diagonal shroud section 74B, then 90 rods will be available to form the second tier vertical shroud section 70B, with further branching taking place up the mast as appropriate. This arrangement reduces the number of composite fiber rods that exit the first exit arm 82A and become the second tier vertical shroud section 70B, which thus reduces the diameter, weight and strength of the second tier vertical shroud section 70B. Due to the fact that higher sections of the mast typically require less tensile strength than lower sections of the mast, smaller diameter rigging can be used at upper tiers compared to lower tiers, so this design achieves the goal of locating strength material where required and not putting material where it is not required. Furthermore, the use of the comparatively lightweight branching tube structure 76A to direct the vertical and diagonal shroud sections helps to reduce the weight above the deck by eliminating the need for multiple terminal fittings that connect to a tipcup on the end of the spreaders, as is required with the prior art discontinuous rigging design shown in FIGS. 3, 4, 7 and 8. The metallic components necessary to direct the branching elements of the rigging are lighter weight compared to tip cups and other hardware that are directly part of the tension member system.

In order to assure that each individual composite fiber carries an approximately equal load, during the manufacture of the continuous composite rigging harness 66, the different shroud sections are preferably laid out along the same path that they will follow as when they are installed on a sailboat. As will be discussed further below, terminating ends of the individual sections of shrouds will be attached such that approximately equal tension will be borne by each composite rod section. This can be accomplished, for example, in the same manner as described with reference to the inventor's co-pending U.S. application Ser. No. 10/197,947 filed on Jul. 16, 2002, namely, by placing the continuous composite rigging harness 66, including its turns and passes through the branching tube structure, on a jig that follows the turn and contours that the continuous composite rigging harness 66 will ultimately take, and pretensioning each of the individual composite fiber rods when attaching the end fittings thereto so that when the continuous composite rigging harness 66 is deployed and installed on a sailboat, the composite fiber rods that make up the harness will be equally tensioned and thus available to equally handle stress. Uneven tensioning of the rods or fiber elements will result in premature failure because only a portion of the strength elements are loaded. Overwrapping of the shroud sections of the harness, e.g., with a strong thread or tape, follows in order to stabilize the harness. A protective fiber braid, polymer or neoprene over-wrap is then applied over the rod bundles.

Figure 12:
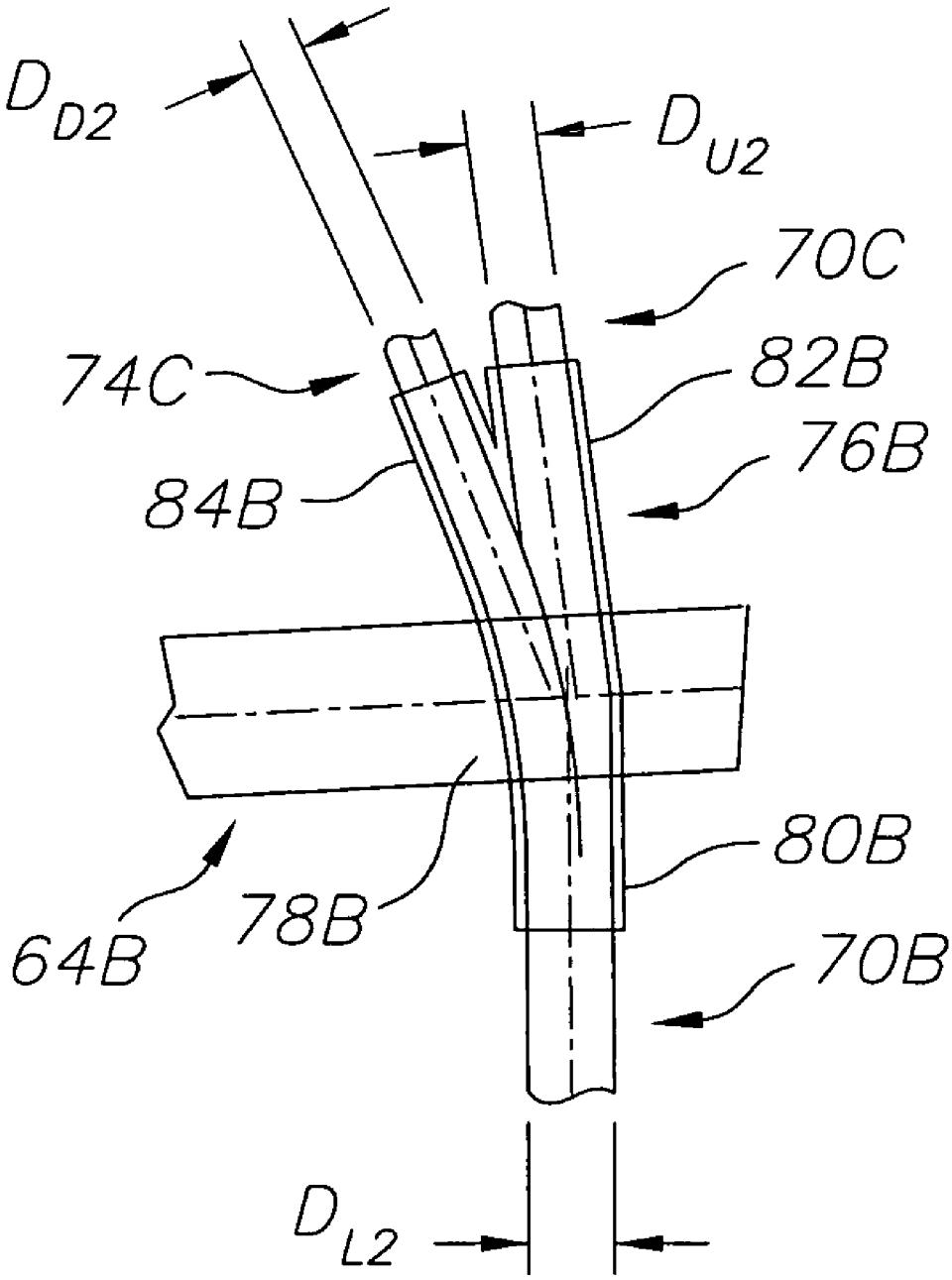
FIG. 12 is a detail of the dashed circle area 12 of FIG. 10 showing the second tier vertical shroud portion, the third tier vertical shroud portion and the third tier diagonal shroud portion engaged by an engagement member to the second tier spreader.

FIG. 12 is a detail of dashed circled area 11 of FIG. 10 showing the second tier vertical shroud portion 70B, the third tier vertical shroud portion 70C and the third tier diagonal shroud portion 74C engaged by a branching tube structure 76B to the second tier spreader 64B. As with the branching tube structure 76A attached to the first tier spreader 64A, the branching tube structure 76B is fitted to an end 78B of the spreader 64B. The branching tube structure 76B will have an entry arm 80B having an internal opening that is sized to fit the second tier vertical shroud section 70B having a diameter $D_{L2}$, a first exit arm 82B for passage of the third tier vertical shroud section 70C, which has a second tier vertical shrouds section diameter $D_{U2}$, and a second exit arm 84B for passage of the third tier diagonal shroud section 74B that has a diameter $D_{D2}$. Due to the branching off of the composite rods entering the entry arm 80B into the second tier diagonal shroud section 74C and the third tier vertical shroud section 70C, the third tier vertical shroud section 70C diameter $D_{U2}$ will be smaller than the second tier vertical shroud section 70B diameter $D_{L2}$. Other aspects of the second tier branching tube structure 76B can remain the same or similar to the first tier branching tube structure 76A and its connection with its shrouds sections 70B, 70C and 74C.

Figure 13:
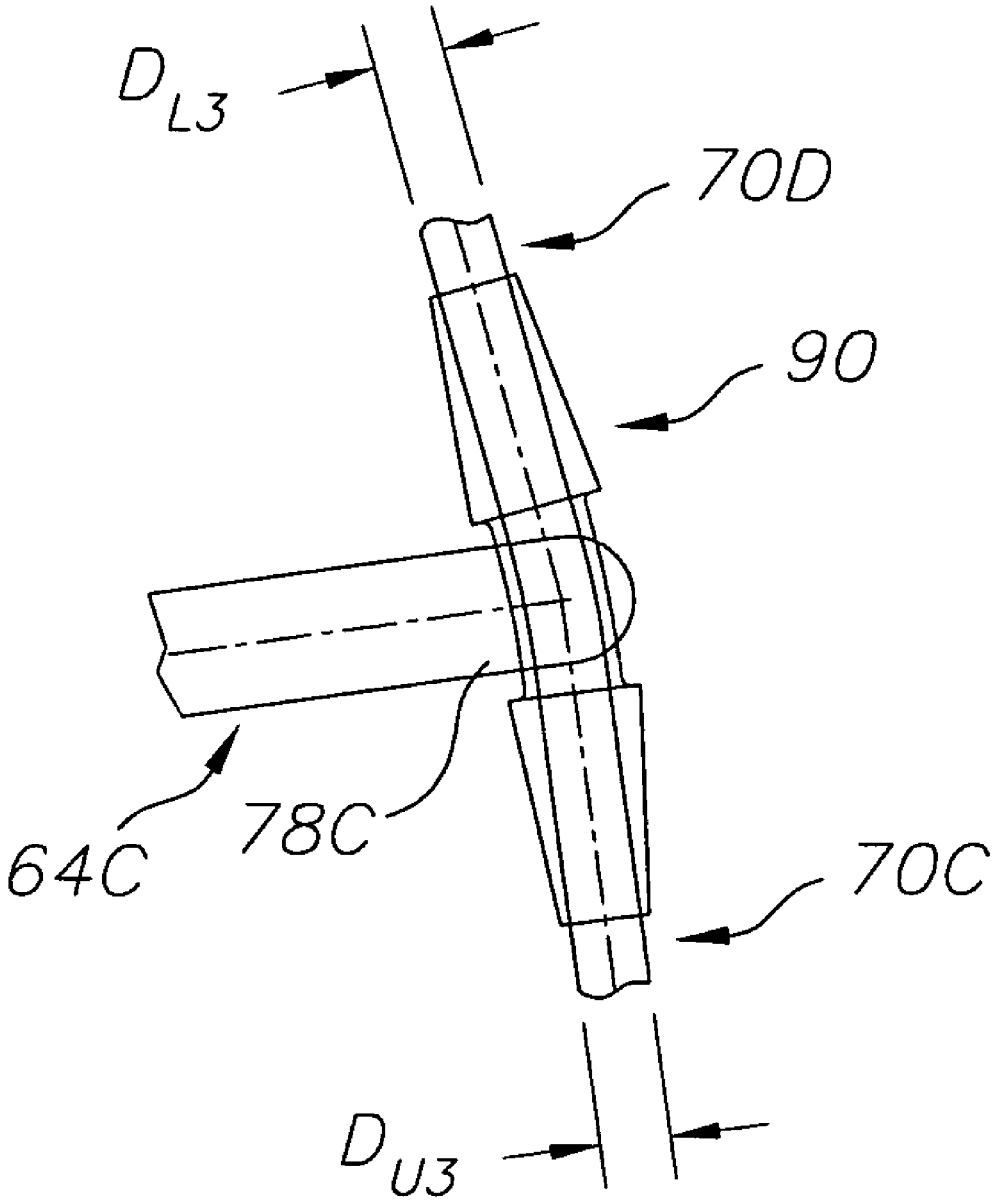
FIG. 13 is a detail of the dashed circle area 13 of FIG. 10 showing the third tier vertical shroud portion and the fourth tier vertical shroud portion engagement member attached to the third tier spreader.

FIG. 13 is a detail of dashed circle area 12 of FIG. 10 showing a third and a fourth tier vertical shroud portion engagement member 90 attached to the end 78C of the third tier spreader 64C. Unlike the case with the branching tube structure 76A and 76B on the ends of spreaders 64A and 64B, respectively, since there is no diagonal rigging section extending from the third tier spreader 64C, there is no need for a branching tube structure. Instead, the vertical rigging section 70C and 70D may extend through the third tier spreader 64C and be fixed thereto by use of the engagement member 90 which is attached to the vertical rigging section 70C and 70D. The engagement member 90 will prevent movement of the vertical rigging section 70C and 70D relative to the third tier spreader 64C. The engagement member 90 can be adhesively fixed to the vertical rigging section 70C and 70D. The engagement member 90 can be held to the spreader by a clamp or lashed in place with safety wire. Other devices to attach the vertical rigging section 70C and 70D to the third tier spreader 64C can be used. There is no branching from vertical rigging section 70C and 70D and the diameter $D_{D3}$ of vertical rigging section 70C is the same diameter $D_{L3}$ of vertical rigging section 70D.

FIG. 14 is a front view of an exemplary mounting structure 36 used to hold shrouds to a portion of the sailboat, e.g., the deck area, a chainplate G, or other structure of the sailboat, as shown and described with reference to FIG. 2. Other types of mounting structures can be used.

FIGS. 15 and 16 are cross-sectional views of an exemplary termination end, e.g., 34A of a section of composite shroud section used in the continuous composite rigging 66 of the invention with an overlay material 92 partially removed. Windings 96, such as strong thread like Kevlar® brand para-aramid fiber can be used to retain the plurality of individual composite rods 94 together in a bundle that makes up the shroud sections. Additionally, the overlay material 92 can comprise weatherproofing or other material, as desired. As can be seen, the plurality of individual composite rods 94 (e.g., glass fiber, carbon fiber, etc.) terminate in a splayed out manner at their end region 98 and are retained in a plug 100. The plug 100 can comprise resin (e.g. epoxy resin with reinforcing fibers such as carbon) that is formed around and molded together with the composite rods 98 to retain them as a unit. During the forming of the conical plug 100 around the splayed out composite rods ends 98, the continuous composite rigging harness 66 will preferably be laid out in generally, and preferably the same angular relationship that the continuous composite rigging harness 66 will assume when it is installed on a sailboat, and the rods will preferably be placed under equal tension. This is done so that each composite fiber strand or rod in the bundle that makes up each shroud section will carry an equal load under tension. The plug 100 preferably has a generally conical or frustum-shaped surface 102 and has a cone angle $\alpha$, and is placed inside a housing portion 104 comprising a body portion 106 and a cap portion 108. The body portion 106 has a cavity 108 adapted to receive the plug 100 and a through opening 110 from which the composite fibers or rods and frustrum exit. The cap portion 108 has a seating face 112 is preferably adapted to make contact with end face 114 of the plug 100 and compress into the cavity 108 in the body portion 106. When a shroud section is pulled, as is the case when shrouds sections are under tension, the plug 100 will be pulled down further into the cavity 108 which acts to further compress the plug. This further increases the holding force between the molded frustrum plug 100 and the individual composite rods 98 located therein. Other designs can be used for the termination fittings including, but not limited to, friction fittings and continuous loop thimbles.

Other designs can be used for the termination fittings, including but not limited to friction fittings, continuous loop thimbles, and the like, and the inventor contemplates that different kids of termination fittings can be utilized in the invention.

Furthermore, although the continuous composite rigging described above has been written up with particular regards to rigging for sailboats, the same or similar continuous composite arrangement of strength elements can be used in other applications where weight-savings, use of few component parts, and/or reduction in wind resistance is a desirable feature such as transportable erectable towers etc.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

What is claimed is:

1. Continuous composite rigging for a sailboat, comprising:

a branched shroud rigging harness having a plurality of generally straight and elongate sections and at least one branched section;

at least one fitting for engaging the at least one branched section of the branched shroud rigging harness; and a terminal fitting on at least some of the generally straight and elongate sections.

2. The continuous composite rigging for a sailboat of claim 1, wherein the branched shroud rigging harness comprises at least one of a plurality of composite fibers and rods that are bundled together.

3. The continuous composite rigging for a sailboat of claim 2, wherein the at least one of a plurality of composite fibers and rods comprise at least one of the group consisting of carbon fiber/epoxy composite rods, glass fiber/epoxy composite rods, aramid fiber/epoxy rods and other combinations of at least one high strength fiber with a polymer matrix.

4. The continuous composite rigging for a sailboat of claim 2, wherein the branched shroud rigging harness has bends but each rod in each generally straight and elongate section has a length and position such that when tension is applied to a terminal fitting on each generally straight and elongate section of the branched shroud rigging harness, each rod will carry approximately the same load.

5. The continuous composite rigging for a sailboat of claim 2, wherein the plurality of bundled together composite fiber rods form a plurality of generally vertical sections and at least one generally diagonal section.

6. The continuous composite rigging for a sailboat of claim 1, wherein the at least one fitting comprises a spreader fitting adapted to attach to a spreader of a sailboat.

7. The continuous composite rigging for a sailboat of claim 6, wherein the at least one spreader fitting comprises a branched tubular guide comprising an entry portion with an inner diameter, and a first and second exit portion.

8. The continuous composite rigging for a sailboat of claim 6, wherein the at least one spreader fitting comprises a branched tubular guide comprising an entry tube with an inner diameter, and a first and second exit tube, wherein one of the generally straight and elongate sections enters the entry tube and branches into the at least one branched section through the branched tubular guide into two generally straight and elongate sections which exit the first and second exit tube.

9. The continuous composite rigging for a sailboat of claim 8, wherein the branched section that extends through the branched tubular guide is held at least one of adhesively and mechanically by virtue of its shape to the branched tubular guide.

10. The continuous composite rigging for a sailboat of claim 8, wherein the branched section that extends through the branched tubular guide is fixed within the branched tubular guide.

11. The continuous composite rigging for a sailboat of claim 1, wherein the branched shroud rigging harness comprises at least one of a plurality of composite fibers and composite rods that are bundled together into a first generally straight and elongate section which branches in the at least one branched section into at least a second and third bundle of generally straight and elongate sections.

12. The continuous composite rigging for a sailboat of claim 11, wherein one of the second and third bundle of generally straight and elongate sections comprises a generally vertical shroud section and the other of the second and third bundle of generally straight and elongate sections comprises a generally diagonal shroud section.

13. The continuous composite rigging for a sailboat of claim 8, wherein the branched shroud rigging harness comprises at least one of a plurality of composite fibers and rods that are bundled together into a plurality of generally vertical sections and a plurality of generally diagonal sections, and wherein the at least one of a bundle of composite fibers and rods that are bundled together into a generally vertical section of the branched shroud rigging harness comprise at least one of composite fibers and rods that enter the entry tube and at least one of composite fibers and rods that comprise another generally vertical section that exits the first exit tube and a generally diagonal section that exits the second exit tube.

14. The continuous composite rigging for a sailboat of claim 2, wherein the branched shroud rigging harness comprises at least one of a plurality of bundles of composite fibers and rods that are bundled together into a plurality of generally vertical sections and a plurality of generally diagonal sections, and wherein groups of the at least one of bundled together composite fibers and rods enter the entry portion and one of the bundles of composite fibers or rods exits the second exit portion to comprise a generally diagonal shroud section and the other bundles of composite fibers or rods exit the first exit portion.

15. The continuous composite rigging for a sailboat of claim 1, wherein the branched portions of the branched shroud rigging harness are affixed to the branched tubular guide with adhesive and mechanically by virtue of its shape.

16. The continuous composite rigging for a sailboat of claim 1, wherein the branched shroud rigging harness has terminating fittings attached to terminal ends of each generally straight and elongate portions thereof, wherein a first end of the branched shroud rigging is fastened to a first terminal end that is adapted to be fixable to a hull portion of the sailboat, and wherein other terminating ends of each section are adapted to be attached to a mast of the sailboat.

17. Continuous composite rigging for a sailboat, comprising:

a branched shroud rigging harness having a plurality of generally straight and elongate sections and at least one branched section, the branched shroud rigging harness comprising a plurality of composite fiber rods that are bundled together and having bends, wherein each rod in each generally straight and elongate section has a length and position such that when tension is applied to a terminal fitting on each generally straight and elongate section of the branched shroud rigging harness, each rod will carry approximately the same load;

at least one spreader fitting adapted to attach to a spreader of a sailboat and for engaging the at least one branched section of the branched shroud rigging harness; and a terminal fitting on at least some of the generally straight and elongate sections, thereby making up the branched shroud rigging harness.

18. The continuous composite rigging for a sailboat of claim 17, wherein the at least one spreader fitting comprises a branched tubular guide comprising an entry portion with an inner diameter, and a first and second exit portion, each with an inner diameter that is smaller than the inner diameter of the entry portion.

19. The continuous composite rigging for a sailboat of claim 18, wherein the branched section that extends through the branched tubular guide is fixed within the branched tubular guide.

20. Continuous composite rigging for a sailboat, comprising:

a branched shroud rigging harness having at least three generally straight and elongate sections and at least one branched section where the branched shroud rigging harness bends, the branched shroud rigging harness being formed of at least one of a plurality of individual composite fibers and rods that are approximately equally pretensioned compared to other composite rods in each particular generally straight and elongate section;

at least one spreader fitting that is attached to a spreader of a sailboat mast for engaging with the at least one branched section of the branched shroud rigging harness; and a terminal fitting on ends of the at least three generally straight and elongate sections, which terminal fittings are connected to terminal end regions of the individual composite fiber rods, wherein the at least one of a plurality of individual composite fibers and rods are approximately equally pretensioned in their respective terminal fitting.

21. The continuous composite rigging for a sailboat of claim 20, wherein the at least one spreader fitting comprises a branched tubular guide comprising an entry tube for passage of a wider diameter section of one of the plurality of generally straight and elongate sections, and two exit tubes for passage of two narrower diameter sections of the plurality of generally straight and elongate sections.

22. The continuous composite rigging for a sailboat of claim 21, wherein the at least one spreader fitting comprises a branched tubular guide comprising an entry tube with an inner diameter, and a first and second exit tube, wherein one of the generally straight and elongate sections enters the entry tube and branches into the at least one branched section through the branched tubular guide into two generally straight and elongate sections which exit the first and second exit tube.

23. The continuous composite rigging for a sailboat of claim 22, wherein the branched section that extends through the branched tubular guide is held at least one of adhesively and mechanically to the branched tubular guide.

24. The continuous composite rigging for a sailboat of claim 22, wherein the branched section that extends through the branched tubular guide is fixed within the branched tubular guide.

25. The continuous composite rigging for a sailboat of claim 22, wherein one of a generally straight and elongate section that enters the entry tube comprises a plurality of separately bundled together groups of composite fiber rods, and the plurality of separately bundled together groups of composite fiber rods separate in passing through the branched tubular guide and out the exit tubes.

* * * * *